United States Patent [19]

Korbach et al.

[11] Patent Number: 4,836,897

[45] Date of Patent: Jun. 6, 1989

[54] BATHS AND PROCESS FOR ELECTROPLATING HARD,ADHERENT,SMOOTH, WEAR RESISTANT AND CORROSION RESISTANT CHROMIUM DEPOSITS

[75] Inventors: William Korbach, Howell; John A. Corsentino, Hazlet; Allen R. Jones, Belford, all of N.J.; John E. McCaskie, Merrick, N.Y.

[73] Assignee: M&T Chemicals Inc., Woodbridge, N.J.

[21] Appl. No.: 239,565

[22] Filed: Sep. 1, 1988

[51] Int. Cl.[4] ..... C25D 3/10

[52] U.S. Cl. ..... 204/51

[58] Field of Search ..... 204/51

[56] References Cited

U.S. PATENT DOCUMENTS 4,472,249 9/1984 Chessin ..... 204/51

*Primary Examiner*—G. L. Kaplan

*Attorney, Agent, or Firm*—S. A. Marcus

[57] ABSTRACT

Corrosion resistant electrodeposited chromium layers, processes for their electrodepositions and plating baths suitable for use therein are disclosed. The corrosion resistant chromium layers also are bright, adherent, smooth, hard, wear resistant, and exhibit a low coefficient of friction. Electrodeposition is carried out at both high and low currrent densities. The baths used comprise 450–650 g/l of chromic acid, 40–100 g/l of sulfoacetic acid and 0–4.5 g/l of sulfate ion and are substantially frêe of other carboxylic acids, fluoride ions, iodide ions, bromide ions and selenium ions.

13 Claims, No Drawings

BATHS AND PROCESS FOR ELECTROPLATING HARD,ADHERENT,SMOOTH, WEAR RESISTANT AND CORROSION RESISTANT CHROMIUM DEPOSITS

BACKGROUND OF INVENTION

1. Field of the Invention

This invention relates to electrodeposited layers, and more particularly, to functional electrodeposited chromium layers having corrosion resistant properties, and to a chromium plating bath and method for forming such corrosion resistant chromium electrodeposits.

2. Description of the Prior Art

Hexavalent chromium plating baths are described in U.S. Pat. Nos. 2,750,337; 3,310,480; 3,311,548; 3,745,097; 3,654,101; 4,234,396; 4,406,756; 4,450,050; 4,472,249; and 4,588,481. These baths generally are intended for "decorative" chromium plating or for "functional" (hard) chromium electrodeposition. Decorative chromium plating baths are concerned with thin chromium deposits over a wide plating range so that articles of irregular shape be completely covered. Functional chromium plating, on the other hand, is designed thicker deposits on regularly shaped articles, where plating at a higher current efficiency and at higher current densities is important.

Functional hexavalent chromium plating baths containing chromic acid and sulfate as a catalyst generally permit the deposition of chromium on a basis metal substrate at cathode efficiencies of about 12% to 16% at current densities of about 1 to 4 asi. Mixed catalyst chromic acid plating baths containing both sulfate and flouride ions generally allow chromium plating at higher cathode efficiencies, e.g. of 22% to 26%, and at higher rates. However, the presence of fluoride ion in such baths causes etching of ferrous based metal substrate.

Other chromium plating baths can operate at even higher current efficiencies, but such baths produce chromium deposits which do not adhere well to the substrate, and which are dull in appearance, or at best only semi-bright. For example, Chessin, in U.S. Pat. No. 4,472,249, describes a high energy efficient functional chromium electroplating bath which operates at very high current efficiencies, e.g. about 50%. These baths generally consist of chromic acid, sulfate, iodide releasing agent, and a carboxylate, and baths are used at conventional current densities between about 1 to 6 asi. Unfortunately, this bath has adherence problems.

Chessin and Newby, in U.S. Pat. No. 4,588,481, described a method for producing non-iridescent, adherent, bright chromium deposits at high efficiences without low current density etching. This method involves plating at a temperature of 45°–70° C. from a functional chromium plating bath consisting essentially of chromic acid and sulfate, and a nonsubstituted alkyl sulfonic acid having a ratio of S/C of $\geqq \frac{1}{3}$, in the absence of a carboxylic or dicarboxylic acid.

Suzuki and Tsukakoshi, in U.S. Pat. Nos. 4,543,172 and 4,593,819, describe a very high speed plating apparatus for electroplating metals, e.g. chromium, within a very short time period. In this method, a flowing plating liquid is circulated at a high speed between a workpiece and anode in the plating chamber. The operating current densities permissible in such a system can range from 50–90 asi, which is an extraordinarily high current density, but which enables plating to occur very rapidly. In fact, the apparatus is referred to in the art as a "Rapid Plating System" (RPS).

Unfortunately, the demands of high-speed chromium plating necessitate a chromium plating bath which can operate under the extreme RPS conditions, and provide high performance chromium electrodeposits.

Accordingly, it is an object of the present invention to provide a high performance electrodeposited chromium layer, a chromium plating bath, and a method for forming such chromium electrodeposits, particularly under RPS conditions.

A specific object herein is to provide chromium electrodeposits which are adherent, bright, smooth, hard, and particularly corrosion resistant, exhibit a low coefficient of friction, and which can be formed at useful current densities, including both the very high operating densities of rapid plating systems, and the low current densities of conventional chromium plating.

These and other objects will be made apparent from the following more detailed description of the invention.

SUMMARY OF INVENTION

In accordance with the above objects of the invention, there is provided herein corrosion resistant chromium electrodeposited layers, a chromium plating bath, and a process by which such high performance, functional chromium electrodeposits can be obtained at conventional plating current densities, and particularly, under high current density rapid plating conditions.

The chromium plating bath of the invention consists essentially of 450 g/l to 640 g/l chromic acid, and sulfoacetic acid, in a concentration range of about 40 g/l to 100 g/l, and preferably, sulfate ion up to a concentration of 6 g/l. Most preferably, the sulfate ion is present at a concentration of 1.5 g/l to 2.5 g/l, and the chromic acid to sulfate ion ratio is about 150 to 350.

The plating bath is further characterized by being substantially free of deleterious carboxylic acids, alkyl sulfonic acids, fluoride ion, bromide ion, selenium ion, and iodide ion.

The plating process of the invention can be carried out at a conventional low current densities, e.g. 1–6 asi. However, the plating bath herein also can be operated under rapid plating conditions, i.e. at very high current densities, e.g. 50–120 asi, or more, at which current densities a substantial deposition can occur within seconds rather than the minutes required at conventional plating current densities.

DETAILED DESCRIPTION OF THE INVENTION

A typcial functional chromium electroplating bath in accordance with the invention has the following constituents present in g/l.

TABLE I

| | Suitable | Preferred |
|---|---|---|
| Constituent | | |
| Chromic acid | 450–650 | 575–625 |
| Sulfoacetic acid* | 40–100 | 70–90 |
| Sulfate ion | 0–4.5 | 1.5–2.5 |
| Chromic acid: Sulfate ion | | 150–350 |
| Operating Conditions | | |
| Rapid Plating (per U.S. 4,543,172) | | |
| Current density (asi) | 50–120 | 90–110 |
| Temperature (°C.) | 50–70 | 55–60 |
| Conventional Plating | | |
| Current density (asi) | 1–5 | 2–3 |

TABLE I-continued

| | Suitable | Preferred |
|---|---|---|
| Temperature (°C.) | 45–70 | 50–60 |

*Sulfoacetic acid can be present also as a sulfoacetate, or isethionic acid, or an isethionate, which can oxidize in the plating bath to provide sulfoacetic acid in the desired concentration.

*Sulfoacetic acid can be present also as a sulfoacetate, or isethionic acid, or an isethionate, which can oxidize in the plating bath to provide sufoacetic acid in the desired concentration.

The current efficiencies of using the plating bath composition of the invention are shown in Table II below for different plating conditions.

A typical chromium electrodeposit formed on a basis metal, e.g. steel, from the electroplating bath of the invention under the conditions described above has the following physical properties, chemical composition and performance characteristics.

TABLE II

| |
|---|
| Physical Properties |
| Adhesion to substrate - excellent |
| Brightness - excellent |
| Structure - cohesive laminar |
| Surface - smooth |
| Thickness - 0.1–2 mils (rapid plating) |
| -> 0.1 mils (conventional plating) |
| Performance Characteristics |
| Hardness - $KN_{100}$ > 1100, e.g. 1100–1400* |
| Coefficient of friction - excellent |
| Wear resistance - excellent |
| Corrosion resistant - excellent |

*$KN_{100}$ is Knoop Hardness employing a 100 g weight. All values are expressed in Knoop Hardness Units (KN).

*$KN_{100}$ is Knoop Hardness employing a 100g weight. All values are expressed in Knoop Hardness Units (KN).

The invention will be described in more detail hereinafter with reference to the following examples.

HIGH CURRENT DENSITY PLATING

(Rapid Plating Conditions)

Example 1

A chromium electroplating solution having the following composition:

| | |
|---|---|
| Chromic acid: | 600 g/l |
| Sulfate ion: | 2.0 g/l |
| Sulfoacetic acid: | 80 g/l |

was circulated at a pump speed of 5 cu. meters/hr. between a steel workpiece and a platinized titanium anode at 60° C., in the apparatus described in U.S. Pat. No. 4,543,172. The current density was 100 asi. This current density is a limitation of the RPS rectifier equipment only and is not to be considered a limitation of the processor. After 20 seconds of plating, a chromium deposit of 0.5 mil. was obtained at a current efficiency of 32%. The chromium deposit had substantially the properties given in Table II above. The hardness value, $KN_{100}$ was 1250. The sulfur content was 0.80% by weight S.

A neutral salt spray corrosion test was carried out on the chromium deposit which involved (etching for 10 sec. at 200 amp. and 30° C. The results show that an average of only 2.8 etch sites were observed, and they were very small. In comparative runs at lower chromic acid concentrations, e.g. 250 g/l, ($CrO_3$:$SO_4$=125:1) an average of 8.7 etch sites were observed, and they were very large.

What is claimed is:

1. A chromium electroplating bath suitable for forming hard, adherent, smooth, wear resistant and corrosion resistant chromium electrodeposits on a substrate consisting essentially of 450–650 g/l of chromic acid 40–100 g/l of sulfoacetic acid and 0–4.5 g/l of sulfate ion wherein said bath is substantially free of other carboxylic acids, fluoride ion, iodide ion, bromide ion, and selenium ion.

2. A chromium electroplating bath according to claim 1 wherein the chromic acid is present in an amount of about 575–625 g/l.

3. A chromium electroplating bath according to claim 1 wherein the chromic acid is present in an amount of 600 g/l.

4. A chromium electroplating bath according to claim 1 wherein the sulfoacetic acid is present in an amount of about 70–90 g/l.

5. A chromium electroplating bath according to claim 1 wherein said bath includes sulfate ion in an amount of 1.5–2.5 g/l.

6. A chromium electroplating bath according to claim 1 wherein the ratio of chromic acid to sulfate ion is about 150:1 to 350:1.

7. A process for electroplating a corrosion resistant chromium layer onto a basis metal, which deposit is bright, hard, smooth, and wear resistant, which comprises electrodepositing from an electroplating bath consisting essentially of 450–650 g/l chromic acid, 40–100 g/l of sulfoacetic acid and 0-4.5 g/l of sulfate ion, said bath being substantially free of other carboxylic acids, flouride ion, iodide ion, bromide ion, and selenium ion.

8. A process according to claim 7 wherein the ratio of chromic acid to sulfate ion is about 150:1 to 350:1.

9. A process according to claim 8 wherein the sulfoacetic acid is present in an amount of about 70–90 g/l.

10. A process according to claim 8 wherein electrodeposition is carried out at a current density of about 50–120 asi.

11. A process according to claim 7 wherein the chromic acid is present in an amount of about 575 g/l to 625 g/l.

12. A process according to claim 7 wherein said elctrodepositing is carried out at temperature of about 50°–70° C.

13. A process according to claim 7 wherein electrodeposition is carried out under conventional plating current densities wherein the current density is about 1–6 asi.

* * * * *